US008480818B2

(12) United States Patent
Ozeki et al.

(10) Patent No.: US 8,480,818 B2
(45) Date of Patent: Jul. 9, 2013

(54) PERMANENT MAGNET AND MANUFACTURING METHOD THEREOF

(75) Inventors: Izumi Ozeki, Ibaraki (JP); Katsuya Kume, Ibaraki (JP); Keisuke Hirano, Ibaraki (JP); Tomohiro Omure, Ibaraki (JP); Keisuke Taihaku, Ibaraki (JP); Takashi Ozaki, Ibaraki (JP)

(73) Assignee: Nitto Denko Corporation, Osaka (JP)

( * ) Notice: Subject to any disclaimer, the term of this patent is extended or adjusted under 35 U.S.C. 154(b) by 0 days.

(21) Appl. No.: 13/499,442

(22) PCT Filed: Mar. 28, 2011

(86) PCT No.: PCT/JP2011/057571
§ 371 (c)(1),
(2), (4) Date: Mar. 30, 2012

(87) PCT Pub. No.: WO2011/125590
PCT Pub. Date: Oct. 13, 2011

(65) Prior Publication Data

US 2012/0182106 A1 Jul. 19, 2012

(30) Foreign Application Priority Data

Mar. 31, 2010 (JP) ..... 2010-082235

(51) Int. Cl.
*H01F 1/057* (2006.01)

(52) U.S. Cl.
USPC ..... 148/302; 75/244; 148/101; 419/12

(58) Field of Classification Search
USPC ..... 148/101, 302; 419/12; 75/244
See application file for complete search history.

(56) References Cited

U.S. PATENT DOCUMENTS 5,595,608 A * 1/1997 Takebuchi et al. ..... 148/104
5,834,663 A * 11/1998 Fukuno et al. ..... 75/244
2004/0177899 A1* 9/2004 Nishizawa et al. ..... 148/302

(Continued)

FOREIGN PATENT DOCUMENTS

JP 64-68903 A 3/1989
JP 1-247502 A 10/1989

(Continued)

OTHER PUBLICATIONS

Partial English Translation of JP Patent Application No. 64-68903.*

(Continued)

*Primary Examiner* — Roy King
*Assistant Examiner* — Timothy Haug
(74) *Attorney, Agent, or Firm* — Sughrue Mion, PLLC

(57) ABSTRACT

There are provided a permanent magnet and a manufacturing method thereof capable of preventing grain growth in a main phase and enabling rare-earth rich phase to be uniformly dispersed. To fine powder of milled neodymium magnet material is added an organometallic compound solution containing an organometallic compound expressed with a structural formula of M-$(OR)_x$ (in the formula, M represents Cu or Al, R represents a substituent group consisting of a straight-chain or branched-chain hydrocarbon, $_x$ represents an arbitrary integer) so as to uniformly adhere the organometallic compound to particle surfaces of the neodymium magnet powder. Thereafter, a compact body formed by compacting the above neodymium magnet powder is held for several hours in hydrogen atmosphere at 200 through 900 degrees Celsius. Thereafter, through a sintering process, a permanent magnet is manufactured.

3 Claims, 5 Drawing Sheets

U.S. PATENT DOCUMENTS

| | | | | |
|---|---|---|---|---|
| 2010/0051140 | A1* | 3/2010 | Nagata et al. | 148/102 |
| 2010/0182113 | A1* | 7/2010 | Yoshimura et al. | 335/302 |
| 2010/0231338 | A1* | 9/2010 | Morimoto et al. | 335/302 |
| 2011/0267160 | A1* | 11/2011 | Ozeki et al. | 335/302 |
| 2012/0146444 | A1* | 6/2012 | Horiuchi et al. | 310/152 |

FOREIGN PATENT DOCUMENTS

| | | | |
|---|---|---|---|
| JP | 5-271708 | A | 10/1993 |
| JP | 2002-363607 | | 12/2002 |
| JP | 3728316 | B2 | 10/2005 |

OTHER PUBLICATIONS

International Search Report (PCT/ISA/210), issued by the International Searching Authority in corresponding International Application No. PCT/JP2011/057571 on Jun. 7, 2011.

Supplementary European Search Report issued in Application No. 11765490.5 dated Oct. 5, 2012.

* cited by examiner

FIG. 6

| | M | OR | CALCINATION | CARBON CONTENT (wt%) |
|---|---|---|---|---|
| EMBODIMENT | Al | ETHOXIDE | YES | 0.10 |
| COMPARATIVE EXAMPLE | Cu | ACETYLACETONATE | YES | 0.24 |

ADDITIVE M-(OR)x

PERMANENT MAGNET AND MANUFACTURING METHOD THEREOF

CROSS REFERENCE TO RELATED APPLICATIONS

This application is a National Stage of International Application No. PCT/JP2011/057571 filed Mar. 28, 2011, claiming priority based on Japanese Patent Application No. 2010-082235 filed Mar. 31, 2010, the contents of all of which are incorporated herein by reference in their entirety.

TECHNICAL FIELD

The present invention relates to a permanent magnet and manufacturing method thereof.

BACKGROUND ART

In recent years, a decrease in size and weight, an increase in power output and an increase in efficiency have been required in a permanent magnet motor used in a hybrid car, a hard disk drive, or the like. To realize such a decrease in size and weight, an increase in power output and an increase in efficiency in the permanent magnet motor mentioned above, a further improvement in magnetic performance is required of a permanent magnet to be buried in the permanent magnet motor. Meanwhile, as permanent magnet, there have been known ferrite magnets, Sm—Co-based magnets, Nd—Fe—B-based magnets, $Sm_2Fe_{17}N_x$-based magnets or the like. As permanent magnet for permanent magnet motor, there are typically used Nd—Fe—B-based magnets among them due to remarkably high residual magnetic flux density.

As method for manufacturing a permanent magnet, a powder sintering process is generally used. In this powder sintering process, raw material is coarsely milled first and furthermore, is finely milled into magnet powder by a jet mill (dry-milling) method. Thereafter, the magnet powder is put in a mold and pressed to form in a desired shape with magnetic field applied from outside. Then, the magnet powder formed and solidified in the desired shape is sintered at a predetermined temperature (for instance, at a temperature between 800 and 1150 degrees Celsius for the case of Nd—Fe—B-based magnet) for completion.

Further, there are conventionally practiced, when manufacturing permanent magnet, to increase the amount of rare earth elements among the constituent elements contained in the magnet raw material larger than the amount based upon stoichiometric composition (for example, Nd: 26.7 wt %, Fe (electrolytic iron): 72.3 wt %, B: 1.0 wt %) so as to form a phase which is rich in rare earth elements (such as Nd-rich phase) in grain boundaries (hereinafter abbreviated to "rich phase").

Then, in the permanent magnet, the rich phase has the following features. The rich phase:

(1) has a low melting point (approx. 600 degrees Celsius) and turns into a liquid phase at sintering, contributing to densification of the magnet, which means improvement in magnetization;
(2) can eliminate surface irregularity of the grain boundaries, decreasing nucleation sites of reverse magnetic domain and enhancing coercive force; and
(3) can magnetically insulate the main phase, increasing the coercive force.

Poorly dispersed rich phase in the sintered permanent magnet potentially causes a partial sintering defect and degrade in the magnetic property; therefore it is important to have the rich phase uniformly dispersed in the sintered permanent magnet.

PRIOR ART DOCUMENT

Patent Document

Patent document 1: Japanese Registered Patent Publication No. 3728316 (pages 4 through 6)

DISCLOSURE OF THE INVENTION

Problem to be Solved by the Invention

Here, as a technique for dispersing the rich phase uniformly, there has been conventionally used a method of adding Cu (copper) or Al (aluminum) to the permanent magnet. It is known that the rich phase can be dispersed uniformly if the Cu or Al is present in grain boundaries.

However, if the magnet raw material is to be milled and sintered with Cu or Al added thereto beforehand, Cu or Al needs moving from the main phase to grain boundaries during sintering. In such a case, it is necessary to set the sintering temperature higher than the usual sintering temperature, or to set the sintering period longer. As a result, grain growth is induced in the main phase at sintering. Here, the grain growth in the main phase causes the coercive force to decrease.

The invention has been made in order to solve the above-mentioned conventional problems, and an object of the invention is to provide a permanent magnet in which organometallic compound containing Cu or Al is added to the magnet powder, thereby enabling Cu or Al contained in the organometallic compound to be concentrated in advance in the grain boundaries of the magnet before sintering, so that grain growth can be prevented in the main phase and at the same time the rich phase can be uniformly dispersed; and a method for manufacturing the permanent magnet.

Means for Solving the Problem

To achieve the above object, the present invention provides a permanent magnet manufactured through steps of: milling magnet material into magnet powder; adding an organometallic compound expressed with a structural formula of $M\text{-}(OR)_x$ (M representing Cu or Al, R representing a substituent group consisting of a straight-chain or branched-chain hydrocarbon, and $_x$ representing an arbitrary integer) to the magnet powder obtained at the step of milling magnet material, and getting the organometallic compound adhered to particle surfaces of the magnet powder; compacting the magnet powder of which particle surfaces have got adhesion of the organometallic compound so as to obtain a compact body; and sintering the compact body.

In the above-described permanent magnet of the present invention, metal contained in the organometallic compound is concentrated in grain boundaries of the permanent magnet after sintering.

In the above-described permanent magnet of the present invention, R in the structural formula $M\text{-}(OR)_x$ is an alkyl group.

In the above-described permanent magnet of the present invention, R in the structural formula $M\text{-}(OR)_x$ is an alkyl group of which carbon number is any one of integer numbers 2 through 6.

To achieve the above object, the present invention further provides a manufacturing method of a permanent magnet comprising steps of milling magnet material into magnet powder; adding an organometallic compound expressed with a structural formula of M-$(OR)_x$ (M representing Cu or Al, R representing a substituent group consisting of a straight-chain or branched-chain hydrocarbon, and $_x$ representing an arbitrary integer) to the magnet powder obtained at the step of milling magnet material and getting the organometallic compound adhered to particle surfaces of the magnet powder; compacting the magnet powder of which particle surfaces have got adhesion of the organometallic compound so as to obtain a compact body; and sintering the compact body.

In the above-described manufacturing method of permanent magnet of the present invention, R in the structural formula is an alkyl group.

In the above-described manufacturing method of permanent magnet of the present invention, R in the structural formula is an alkyl group of which carbon number is any one of integer numbers 2 through 6.

Effect of the Invention

According to the permanent magnet of the present invention as above configured, through adding the organometallic compound containing Cu or Al to the magnet powder, Cu or Al contained in the organometallic compound can be concentrated in advance to the grain boundaries in a magnet before sintering. Thus, compared with the case where Cu or Al is initially contained in the magnet raw material and then milled and sintered, there can be eliminated the need to set the sintering temperature higher or the sintering period longer in the manufacturing process of the permanent magnet. As a result, the grain growth in the main phase can be inhibited and the rich phase can be dispersed uniformly.

Further, according to the permanent magnet of the present invention, Cu or Al is concentrated at the grain boundaries in a magnet, therefore the rich phase can be dispersed uniformly and improvement of coercive force can be realized.

Further, according to the permanent magnet of the present invention, an organometallic compound including alkyl group is employed as organometallic compound to be added to magnet powder, so that it becomes easy to thermally decompose the organometallic compound. As a result, the carbon content in the magnet powder or the compact body can be more reliably reduced when the magnet powder or the compact body is calcined in hydrogen atmosphere before sintering. Consequently, alpha iron can be prevented from separating out and the whole magnet can be densely sintered, and decline of coercive force can be avoided.

Further, according to the permanent magnet of the present invention, as organometallic compound to be added to the magnet powder, an organometallic compound consisting of an alkyl group of which carbon number is any one of integer numbers 2 through 6, which enables the organometallic compound to thermally decompose at a low temperature. As a result, when calcining the magnet powder or the compact body in hydrogen atmosphere before sintering, thermal decomposition of the organometallic compound can be more easily performed over the entirety of the magnet powder or the compact body. That is, the carbon content in the magnet powder or the compact body can be more reliably reduced through the calcination process.

According to the manufacturing method of a permanent magnet of the present invention, through adding the organometallic compound containing Cu or Al to the magnet powder, Cu or Al contained in the organometallic compound can be concentrated in advance to the grain boundaries in a magnet before sintering. Thus, compared with the case where Cu or Al is initially contained in the magnet raw material and then milled and sintered, there can be eliminated the need to set the sintering temperature higher or the sintering period longer in the manufacturing process of the permanent magnet. As a result, the grain growth in the main phase can be inhibited and the rich phase can be dispersed uniformly.

Further, according to the manufacturing method of a permanent magnet of the present invention, an organometallic compound including alkyl group is employed as organometallic compound to be added to magnet powder, so that it becomes easy to thermally decompose the organometallic compound. As a result, the carbon content in the magnet powder or the compact body can be more reliably reduced when the magnet powder or the compact body is calcined in hydrogen atmosphere before sintering. Consequently, alpha iron can be prevented from separating out and the whole magnet can be densely sintered, and decline of coercive force can be avoided.

Further, according to the manufacturing method of a permanent magnet of the present invention, as organometallic compound to be added to the magnet powder, an organometallic compound consisting of an alkyl group of which carbon number is any one of integer numbers 2 through 6, which enables the organometallic compound to thermally decompose at a low temperature. As a result, when calcining the magnet powder or the compact body in hydrogen atmosphere before sintering, thermal decomposition of the organometallic compound can be more easily performed over the entirety of the magnet powder or the compact body. That is, the carbon content in the magnet powder or the compact body can be more reliably reduced through the calcination process.

BRIEF DESCRIPTION OF THE DRAWINGS

FIG. 6 is a table illustrating residual carbon content in permanent magnets of an embodiment and a comparative example.

BEST MODE FOR CARRYING OUT THE INVENTION

Specific embodiments of a permanent magnet and a method for manufacturing the permanent magnet according to the present invention will be described below in detail with reference to the drawings.

[Constitution of Permanent Magnet]

Figure 1:
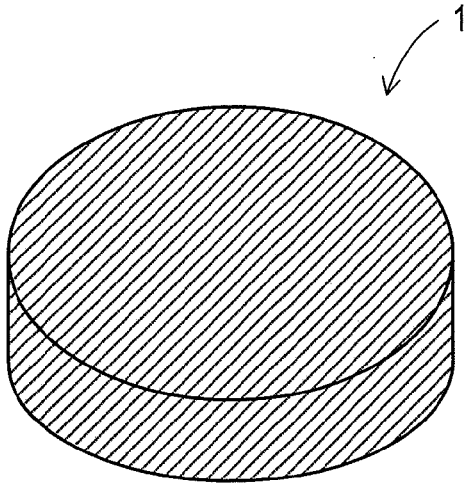
FIG. 1 is an overall view of a permanent magnet directed to the invention.

First, a constitution of a permanent magnet 1 will be described. FIG. 1 is an overall view of the permanent magnet directed to the present invention. Incidentally, the permanent magnet 1 depicted in FIG. 1 is formed into a cylindrical shape. However, the shape of the permanent magnet 1 may be changed in accordance with the shape of a cavity used for compaction.

As the permanent magnet 1 according to the present invention, a Nd—Fe—B-based magnet may be used, for example.

Figure 2:
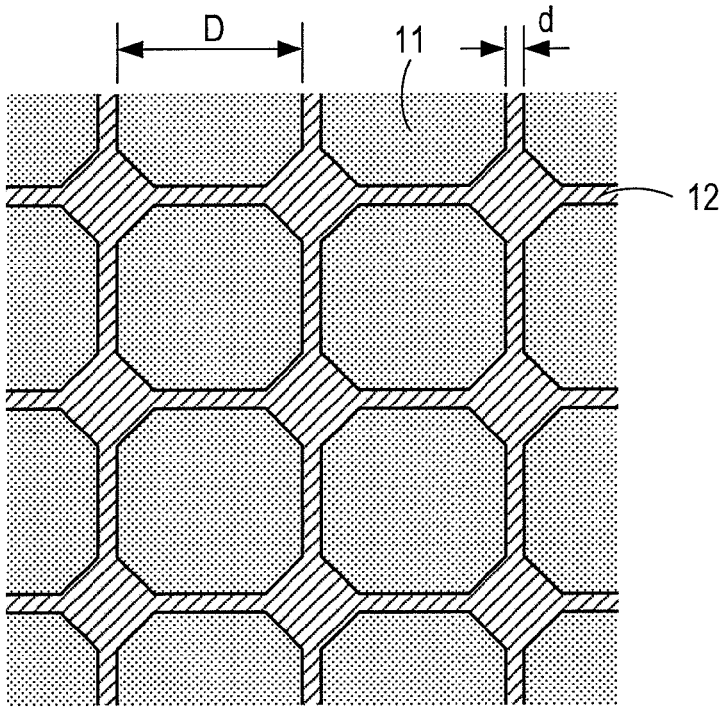
FIG. 2 is an enlarged schematic view in vicinity of grain boundaries of the permanent magnet directed to the invention.

Further, as illustrated in FIG. 2, the permanent magnet 1 is an alloy in which a main phase 11 and an R-rich phase 12 coexist. The main phase 11 is a magnetic phase which contributes to the magnetization and the R-rich phase 12 is a low-melting-point and non-magnetic phase where rare earth elements are concentrated (in the description relating to the R-rich phase, R includes at least one of Nd, Pr, Dy and Tb, each of which is a rare earth element). FIG. 2 is an enlarged view of Nd magnet particles composing the permanent magnet 1.

Here, in the main phase 11, $Nd_2Fe_{14}B$ intermetallic compound phase (Fe here may be partially replaced with Co), which is of a stoichiometric composition, accounts for high proportion in volume. Meanwhile, the R-rich phase 12 consists of an intermetallic compound phase having higher composition ratio of R than that of $R_2Fe_{14}B$ (Fe here may be partially replaced with Co) of also a stoichiometric composition (for example, $R_{2.0\text{-}3.0}Fe_{14}B$ intermetallic compound phase). Further, the R-rich phase 12 includes Cu or Al for improving magnetic property as later described.

Then, in the permanent magnet 1, the R-rich phase 12 has the following features. The R-rich phase 12:

(1) has a low melting point (approx. 600 degrees Celsius) and turns into a liquid phase at sintering, contributing to densification of the magnet, which means improvement in magnetization;

(2) can eliminate surface irregularity of the grain boundaries, decreasing nucleation sites of reverse magnetic domain and enhancing coercive force; and (3) can magnetically insulate the main phase, increasing the coercive force.

Poorly dispersed R-rich phase 12 in the sintered permanent magnet 1 potentially causes a partial sintering defect or degrade in the magnetic property; therefore it is important to have the R-rich phase 12 uniformly dispersed in the sintered permanent magnet 1.

An example of problems likely to rise when manufacturing the Nd—Fe—B-based magnet is formation of alpha iron in a sintered alloy. This may be caused as follows: when a permanent magnet is manufactured using a magnet raw material alloy whose contents are based on the stoichiometric composition, rare earth elements therein combine with oxygen during the manufacturing process so that the amount of rare earth elements becomes insufficient in comparison with the stoichiometric composition. Further, if alpha iron remains in the magnet after sintering, the magnetic property of the magnet is degraded.

It is thus desirable that the amount of all rare earth elements contained in the permanent magnet 1, including Nd and R, is within a range of 0.1 wt % through 10.0 wt % larger, or more preferably, 0.1 wt % through 5.0 wt % larger than the amount based upon the stoichiometric composition (26.7 wt %). Specifically, the contents of constituent elements are set to be $Nd^+$ R: 25 through 37 wt %, B: 1 through 2 wt %, Fe (electrolytic iron): 60 through 75 wt %, respectively. By setting the contents of rare earth elements in the permanent magnet within the above range, it becomes possible to obtain the sintered permanent magnet 1 in which the R-rich phase 12 is uniformly dispersed. Further, even if the rare earth elements are combined with oxygen during the manufacturing process, the formation of alpha iron in the sintered permanent magnet 1 can be prevented, without shortage of the rare earth elements in comparison with the stoichiometric composition.

Incidentally, if the amount of rare earth elements contained in the permanent magnet 1 is smaller than the above-described range, the R-rich phase 12 becomes difficult to be formed. Also, the formation of alpha iron cannot sufficiently be inhibited. Meanwhile, in a case the content of rare earth elements in the permanent magnet 1 is larger than the above-described range, the increase of the coercive force becomes slow and also the residual magnetic flux density is reduced. Therefore such a case may be impracticable.

Further, in this invention, Cu or Al is included in the R-rich phase 12, making it possible to uniformly disperse the R-rich phase 12 within the sintered permanent magnet 1.

Here, in this invention, addition of Cu or Al to the R-rich phase 12 is performed in a manner that an organometallic compound containing Cu or Al is added to the milled magnet powder before compacting the milled magnet powder, as later described. Specifically, through adding the organometallic compound containing Cu or Al, the Cu or Al in the organometallic compound is uniformly attached to the particle surfaces of the Nd magnet particles by means of wet dispersion. Then, under this condition, the magnet powder is sintered and the Cu or Al in the organometallic compound uniformly attached to the particle surfaces of the Nd magnet particles is concentrated in the grain boundaries of the main phase 11, in other words, in the R-rich phase 12.

Furthermore, in the present invention, specifically as later described, the organometallic compound containing Cu or Al is expressed by $M\text{-}(OR)_x$ (in the formula, M represents Cu or Al, R represents a substituent group consisting of a straight-chain or branched-chain hydrocarbon and $_x$ represents an arbitrary integer), and the organometallic compound containing Cu or Al (such as aluminum ethoxide) is added to organic solvent and mixed with the magnet powder in a wet state. Thus, the organometallic compound containing Cu or Al is dispersed in the organic solvent, enabling the organometallic compound containing Cu or Al to be adhered onto the particle surfaces of Nd magnet particles effectively.

Here, metal alkoxide is one of the organometallic compounds that satisfy the above structural formula $M\text{-}(OR)_x$ (in the formula, M represents Cu or Al, R represents a substituent group consisting of a straight-chain or branched-chain hydrocarbon and $_x$ represents an arbitrary integer). The metal alkoxide is expressed by a general formula $M\text{-}(OR)_n$ (M: metal element, R: organic group, n: valence of metal or metalloid). Furthermore, examples of metal or metalloid composing the metal alkoxide include W, Mo, V, Nb, Ta, Ti, Zr, Ir, Fe, Co, Ni, Cu, Zn, Cd, Al, Ga, In, Ge, Sb, Y, lanthanide and the like. However, in the present invention, Cu or Al is specifically used.

Furthermore, the types of the alkoxide are not specifically limited, and there may be used, for instance, methoxide, ethoxide, propoxide, isopropoxide, butoxide or alkoxide carbon number of which is 4 or larger. However, in the present invention, those of low-molecule weight are used in order to reduce the carbon residue by means of thermal decomposition at a low temperature to be later described. Furthermore, methoxide carbon number of which is 1 is prone to decompose and difficult to deal with, therefore it is preferable to use alkoxide carbon number of which is 2 through 6 included in R, such as ethoxide, methoxide, isopropoxide, propoxide or butoxide. That is, in the present invention, it is preferable to use, as the organometallic compound to be added to the magnet powder, an organometallic compound expressed by $M\text{-}(OR)_x$ (in the formula, M represents Cu or Al, R represents a straight-chain or branched-chain alkyl group and, represents an arbitrary integer) or it is more preferable to use an organometallic compound expressed by $M\text{-}(OR)_x$ (in the formula, M represents Cu or Al, R represents a straight-chain or branched-chain alkyl group of which carbon number is 2 through 6, and $_x$ represents an arbitrary integer).

Further, it is desirable to set the crystal grain diameter D of the main phase 11 to be 0.1 μm through 5.0 μm. Furthermore, the thickness d of the R-rich phase 12 may be 1 nm through 500 nm, or preferably 2 nm through 200 nm. As a result, the phase of the $Nd_2Fe_{14}B$ intermetallic compound of the core accounts for the large proportion in volume, with respect to crystal grains as a whole (in other words, the sintered magnet in its entirety). Accordingly, the decrease of the residual magnetic flux density (magnetic flux density at the time when the intensity of the external magnetic field is brought to zero) can be inhibited. The structure of the main phase 11 and the R-rich phase 12 can be confirmed, for instance, through scanning electron microscopy (SEM), transmission electron microscopy (TEM) or three-dimensional atom probe technique.

If Dy or Tb is included in M in the formula $M\text{-}(OR)_x$, it becomes possible to concentrate Dy or Tb in the grain boundaries of magnet particles. As a result, coercive force can be improved by Dy or Tb.

[First Method for Manufacturing Permanent Magnet]

Figure 3:
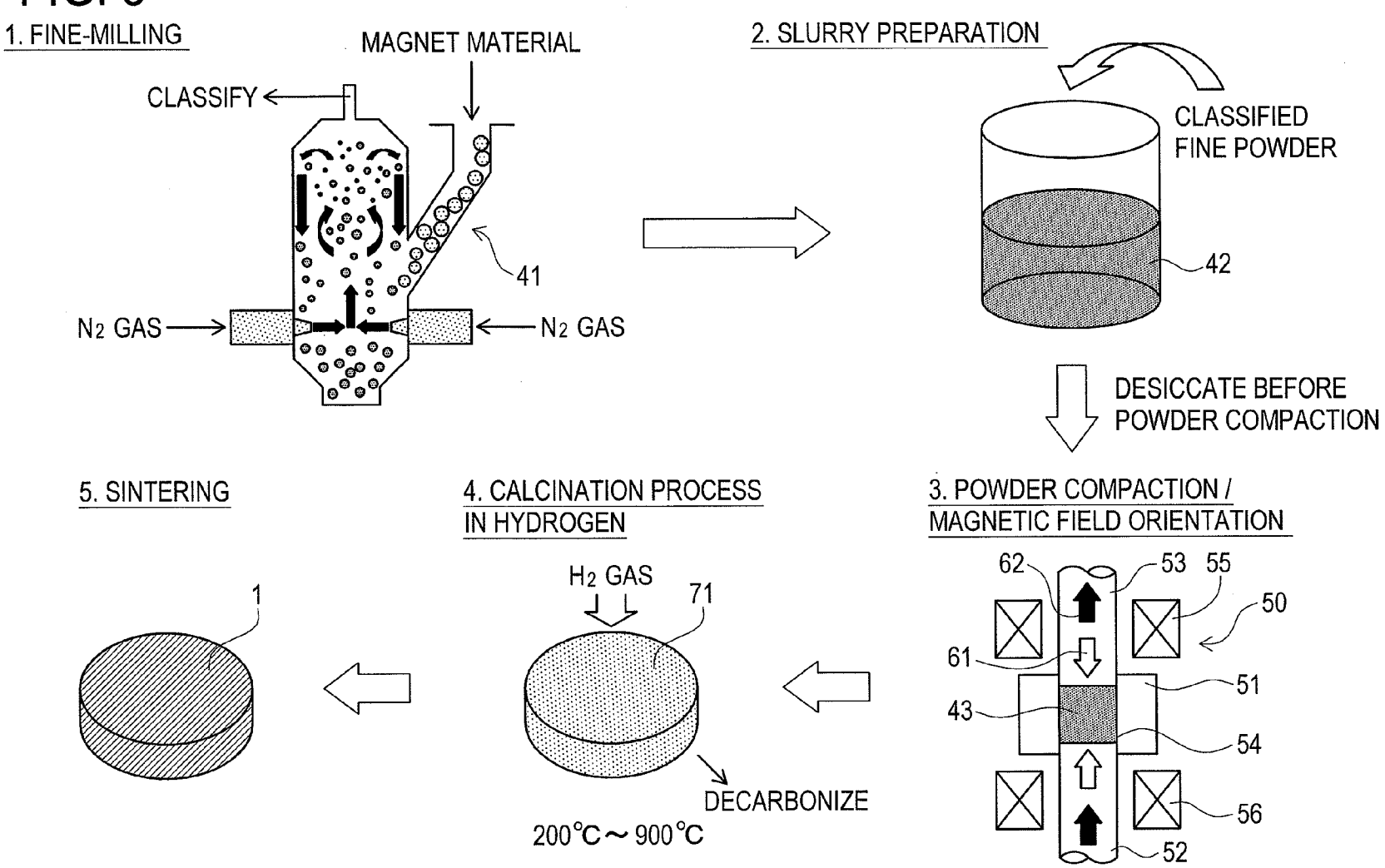
FIG. 3 is an explanatory diagram illustrating manufacturing processes of a permanent magnet according to a first manufacturing method of the invention.

Next, the first method for manufacturing the permanent magnet 1 directed to the present invention will be described below with reference to FIG. 3. FIG. 3 is an explanatory view illustrating a manufacturing process in the first method for manufacturing the permanent magnet 1 directed to the present invention.

First, there is manufactured an ingot comprising Nd—Fe—B of certain fractions (for instance, Nd: 32.7 wt %, Fe (electrolytic iron): 65.96 wt %, and B: 1.34 wt %). Here, the Nd content of the ingot is set to be 0.1 wt % through 10.0 wt % larger, or more preferably, 0.1 wt % through 5.0 wt % larger than the content based on the stoichiometric composition (26.7 wt %). Furthermore, a small amount of Dy or Tb may be included for the purpose of increasing the coercive force. Thereafter the ingot is coarsely milled using a stamp mill, a crusher, etc. to a size of approximately 200 μm. Otherwise, the ingot is dissolved, formed into flakes using a strip-casting method, and then coarsely milled using a hydrogen pulverization method.

Next, the coarsely milled magnet powder is finely milled with a jet mill 41 to form fine powder of which the average particle diameter is smaller than a predetermined size (for instance, 0.1 μm through 5.0 μm) in: (a) an atmosphere composed of inert gas such as nitrogen gas, argon (Ar) gas, helium (He) gas or the like having an oxygen content of substantially 0%; or (b) an atmosphere composed of inert gas such as nitrogen gas, Ar gas, He gas or the like having an oxygen content of 0.0001 through 0.5%. Here, the term "having an oxygen content of substantially 0%" is not limited to a case where the oxygen content is completely 0%, but may include a case where oxygen is contained in such an amount as to allow a slight formation of an oxide film on the surface of the fine powder.

In the meantime, organometallic compound solution is prepared for adding to the fine powder finely milled by the jet mill 41. Here, an organometallic compound containing Cu or Al is added in advance to the organometallic compound solution and dissolved therein. Incidentally, in the present invention, it is preferable to use, as the organometallic compound to be dissolved, an organometallic compound (such as aluminum ethoxide) pertinent to formula $M\text{-}(OR)_x$ (in the formula, M represents Cu or Al, R represents a straight-chain or branched-chain alkyl group of which carbon number is 2 through 6 and $_x$ represents an arbitrary integer). Furthermore, the amount of the organometallic compound containing Cu or Al to be dissolved is not particularly limited; however, it is preferably adjusted to such an amount that the Cu or Al content with respect to the sintered magnet is 0.001 wt % through 10 wt %, or more preferably, 0.01 wt % through 5 wt %.

Successively, the above organometallic compound solution is added to the fine powder classified with the jet mill 41. Through this, slurry 42 in which the fine powder of magnet raw material and the organometallic compound solution are mixed is prepared. Here, the addition of the organometallic compound solution is performed in an atmosphere composed of inert gas such as nitrogen gas, Ar gas or He gas.

Thereafter, the prepared slurry 42 is desiccated in advance through vacuum desiccation or the like before compaction and desiccated magnet powder 43 is obtained. Then, the desiccated magnet powder is subjected to powder-compaction to form a given shape using a compaction device 50. There are dry and wet methods for the powder compaction, and the dry method includes filling a cavity with the desiccated fine powder and the wet method includes preparing slurry of the desiccated fine powder using solvent and then filling a cavity therewith. In this embodiment, a case where the dry method is used is described as an example. Furthermore, the organometallic compound solution can be volatilized at the sintering stage after compaction.

As illustrated in FIG. 3, the compaction device 50 has a cylindrical mold 51, a lower punch 52 and an upper punch 53, and a space surrounded therewith forms a cavity 54. The lower punch 52 slides upward/downward with respect to the mold 51, and the upper punch 53 slides upward/downward with respect to the mold 51, in a similar manner.

In the compaction device 50, a pair of magnetic field generating coils 55 and 56 is disposed in the upper and lower positions of the cavity 54 so as to apply magnetic flux to the magnet powder 43 filling the cavity 54. The magnetic field to be applied may be, for instance, 1 MA/m.

When performing the powder compaction, firstly, the cavity 54 is filled with the desiccated magnet powder 43. Thereafter, the lower punch 52 and the upper punch 53 are activated to apply pressure against the magnet powder 43 filling the cavity 54 in a pressurizing direction of arrow 61, thereby performing compaction thereof. Furthermore, simultaneously with the pressurization, pulsed magnetic field is applied to the magnet powder 43 filling the cavity 54, using the magnetic field generating coils 55 and 56, in a direction of arrow 62 which is parallel with the pressuring direction. As a result, the magnetic field is oriented in a desired direction. Incidentally, it is necessary to determine the direction in which the magnetic field is oriented while taking into consideration the magnetic field orientation required for the permanent magnet 1 formed from the magnet powder 43.

Furthermore, in a case where the wet method is used, slurry may be injected while applying the magnetic field to the cavity 54, and in the course of the injection or after termination of the injection, a magnetic field stronger than the initial magnetic field may be applied to perform the wet molding. Furthermore, the magnetic field generating coils 55 and 56 may be disposed so that the application direction of the magnetic field is perpendicular to the pressuring direction.

Secondly, the compact body 71 formed through the powder compaction is held for several hours (for instance, five hours) in hydrogen atmosphere at 200 through 900 degrees Celsius, or more preferably 400 through 900 degrees Celsius (for instance, 600 degrees Celsius), to perform a calcination process in hydrogen. The hydrogen feed rate during the calcination is 5 L/min. So-called decarbonization is performed during this calcination process in hydrogen. In the decarbonization, the organometallic material is thermally decomposed so that carbon content in the calcined body can be decreased. Furthermore, calcination process in hydrogen is to be performed under a condition of 0.2 wt % carbon content or less in the calcined body, or more preferably 0.1 wt % or less. Accordingly, it becomes possible to densely sinter the permanent magnet 1 as a whole in the following sintering process, and the decrease in the residual magnetic flux density and coercive force can be prevented.

Here, $NdH_3$ exists in the compact body 71 calcined through the calcination process in hydrogen as above described, which indicates a problematic tendency to combine with oxygen. However, in the first manufacturing method, the compact body 71 after the calcination is brought to the later-described sintering without being exposed to the external air, eliminating the need for the dehydrogenation process. The hydrogen contained in the compact body is removed while being sintered.

Following the above, there is performed a sintering process for sintering the compact body 71 calcined through the calcination process in hydrogen. However, for a sintering method for the compact body 71, there can be employed, besides commonly-used vacuum sintering, pressure sintering in which the compact body 71 is sintered in a pressured state. For instance, when the sintering is performed in the vacuum sintering, the temperature is risen to approximately 800 through 1080 degrees Celsius in a given rate of temperature increase and held for approximately two hours. During this period, the vacuum sintering is performed, and the degree of vacuum is preferably equal to or smaller than $10^{-4}$ Torr. The compact body 71 is then cooled down, and again undergoes a heat treatment in 600 through 1000 degrees Celsius for two hours. As a result of the sintering, the permanent magnet 1 is manufactured.

Meanwhile, the pressure sintering includes, for instance, hot pressing, hot isostatic pressing (HIP), high pressure synthesis, gas pressure sintering, and spark plasma sintering (SPS) and the like. However, it is preferable to adopt the spark plasma sintering which is uniaxial pressure sintering in which pressure is uniaxially applied and also in which sintering is performed by electric current sintering, so as to prevent grain growth of the magnet particles during the sintering and also to prevent warpage formed in the sintered magnets. Incidentally, the following are the preferable conditions when the sintering is performed in the SPS; pressure is applied at 30 MPa, the temperature is risen in a rate of 10 degrees Celsius per minute until reaching 940 degrees Celsius in vacuum atmosphere of several Pa or lower and then the state of 940 degrees Celsius in vacuum atmosphere is held for approximately five minutes. The compact body 71 is then cooled down, and again undergoes a heat treatment in 600 through 1000 degrees Celsius for two hours. As a result of the sintering, the permanent magnet 1 is manufactured.

[Second Method for Manufacturing Permanent Magnet]

Figure 4:
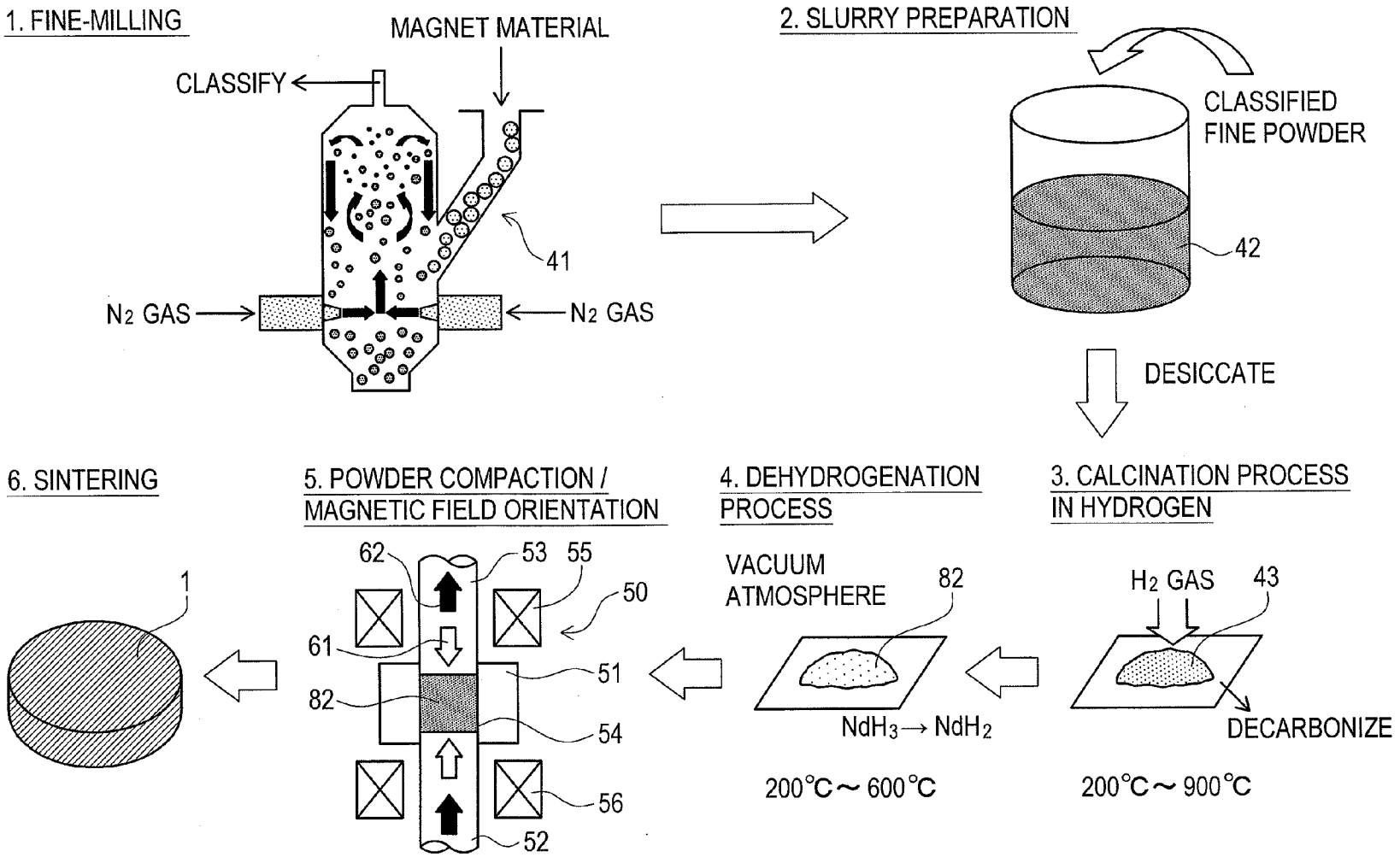
FIG. 4 is an explanatory diagram illustrating manufacturing processes of a permanent magnet according to a second manufacturing method of the invention.

Next, the second method for manufacturing the permanent magnet 1 which is an alternative manufacturing method will be described below with reference to FIG. 4. FIG. 4 is an explanatory view illustrating a manufacturing process in the second method for manufacturing the permanent magnet 1 directed to the present invention.

The process until the slurry 42 is manufactured is the same as the manufacturing process in the first manufacturing method already discussed referring to FIG. 3, therefore detailed explanation thereof is omitted.

Firstly, the prepared slurry 42 is desiccated in advance through vacuum desiccation or the like before compaction and desiccated magnet powder 43 is obtained. Then, the desiccated magnet powder 43 is held for several hours (for instance, five hours) in hydrogen atmosphere at 200 through 900 degrees Celsius, or more preferably 400 through 900 degrees Celsius (for instance, 600 degrees Celsius), for a calcination process in hydrogen. The hydrogen feed rate during the calcination is 5 L/min. So-called decarbonization is performed in this calcination process in hydrogen. In the decarbonization, the organometallic material is thermally decomposed so that carbon content in the calcined body can be decreased. Furthermore, calcination process in hydrogen is to be performed under a condition of 0.2 wt % carbon content or less in the calcined body, or more preferably 0.1 wt % or less. Accordingly, it becomes possible to densely sinter the permanent magnet 1 as a whole in the following sintering process, and the decrease in the residual magnetic flux density and coercive force can be prevented.

Secondly, the powdery calcined body 82 calcined through the calcination process in hydrogen is held for one through three hours in vacuum atmosphere at 200 through 600 degrees Celsius, or more preferably 400 through 600 degrees Celsius for a dehydrogenation process. Incidentally, the degree of vacuum is preferably equal to or smaller than 0.1 Torr.

Here, $NdH_3$ exists in the calcined body 82 calcined through the calcination process in hydrogen as above described, which indicates a problematic tendency to combine with oxygen.

Figure 5:
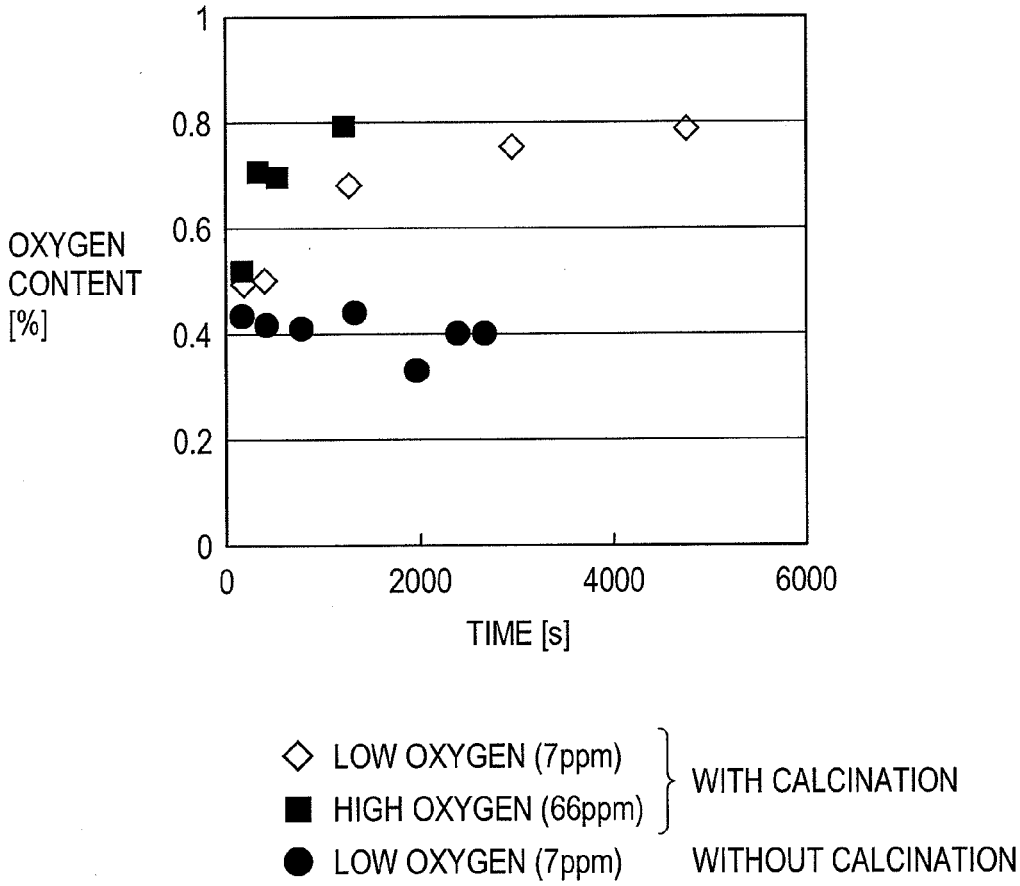
FIG. 5 is a diagram illustrating changes of oxygen content with and without a calcination process in hydrogen.

FIG. 5 is a diagram depicting oxygen content of magnet powder with respect to exposure duration, when Nd magnet powder with a calcination process in hydrogen and Nd magnet powder without a calcination process in hydrogen are exposed to each of the atmosphere with oxygen concentration of 7 ppm and the atmosphere with oxygen concentration of 66 ppm. As illustrated in FIG. 5, when the Nd magnet powder with the calcination process in hydrogen is exposed to the atmosphere with high-oxygen concentration of 66 ppm, the oxygen content of the magnet powder increases from 0.4% to 0.8% in approximately 1000 sec. Even when the Nd magnet powder with the calcination process is exposed to the atmosphere with low-oxygen concentration of 7 ppm, the oxygen content of the magnet powder still increases from 0.4% to the similar amount 0.8%, in approximately 5000 sec. Oxygen combined with Nd causes the decrease in the residual magnetic flux density and in the coercive force.

Therefore, in the above dehydrogenation process, $NdH_3$ (having high activity level) in the calcined body 82 created at the calcination process in hydrogen is gradually changed: from $NdH_3$ (having high activity level) to $NdH_2$ (having low activity level). As a result, the activity level is decreased with respect to the calcined body 82 activated by the calcination process in hydrogen. Accordingly, if the calcined body 82 calcined at the calcination process in hydrogen is later moved into the external air, Nd therein is prevented from combining with oxygen, and the decrease in the residual magnetic flux density and coercive force can also be prevented.

Then, the powdery calcined body 82 after the dehydrogenation process undergoes the powder compaction to be compressed into a given shape using the compaction device 50. Details are omitted with respect to the compaction device 50 because the manufacturing process here is similar to that of the first manufacturing method already described referring to FIG. 3.

Then, there is performed a sintering process for sintering the compacted-state calcined body 82. The sintering process is performed by the vacuum sintering or the pressure sintering similar to the above first manufacturing method. Details of the sintering condition are omitted because the manufacturing process here is similar to that of the first manufacturing method already described. As a result of the sintering, the permanent magnet 1 is manufactured.

However, the second manufacturing method discussed above has an advantage that the calcination process in hydrogen is performed to the powdery magnet particles, therefore the thermal decomposition of the organometallic compound can be more easily caused to the whole magnet particles, in comparison with the first manufacturing method in which the calcination process in hydrogen is performed to the compacted magnet particles. That is, it becomes possible to securely decrease the carbon content of the calcined body, in comparison with the first manufacturing method.

However, in the first manufacturing method, the compact body 71 after calcined in hydrogen is brought to the sintering without being exposed to the external air, eliminating the need for the dehydrogenation process. Accordingly, the manufacturing process can be simplified in comparison with the second manufacturing method. However, also in the second manufacturing method, in a case where the sintering is performed without any exposure to the external air after calcined in hydrogen, the dehydrogenation process becomes unnecessary.

Embodiments

Here will be described embodiments according to the present invention referring to comparative examples for comparison.

(Embodiment)

In comparison with fractions regarding alloy composition of a neodymium magnet according to the stoichiometric composition (Nd: 26.7 wt %, Fe (electrolytic iron): 72.3 wt %, B: 1.0 wt %), proportion of Nd in that of the neodymium magnet powder for the embodiment is set higher, such as Nd/Fe/B=32.7/65.96/1.34 in wt %, for instance. Further, 5 wt % of aluminum ethoxide has been added as organometallic compound containing Cu or Al to milled neodymium magnet powder. A calcination process has been performed by holding the magnet powder before compaction for five hours in hydrogen atmosphere at 600 degrees Celsius. The hydrogen feed rate during the calcination is 5 L/min. Sintering of the compacted-state calcined body has been performed in the SPS. Other processes are the same as the processes in [Second Method for Manufacturing Permanent Magnet] mentioned above.

COMPARATIVE EXAMPLE

Copper acetylacetonate has been used as organometallic compound to be added. Other conditions are the same as the conditions in the embodiment.

Comparison of Embodiment with Comparative Example Regarding Residual Carbon Content The table of FIG. 6 shows residual carbon content [wt %] in each permanent magnet according to the embodiment and the comparative example.

As shown in FIG. 6, the carbon content remaining in the magnet particles can be significantly reduced in the embodiment in comparison with the comparative example. Specifically, the carbon content remaining in the magnet particles can be made 0.2 wt % or less, more specifically, 0.1 wt % or less, in the embodiment.

In comparison between the embodiment and the comparative example, carbon content in the magnet particles can be more significantly decreased in the case of adding an organometallic compound represented as M-$(OR)_x$ (in the formula, M represents Cu or Al, R represents an alkyl group of straight-chain or branched-chain and $_x$ represents an arbitrary integer), than the case of adding other organometallic compound. In other words, decarbonization can be easily caused during the calcination process in hydrogen by using an organometallic compound represented as M-$(OR)_x$ (in the formula, M represents Cu or Al, R represents a substituent group consisting of a straight-chain or branched-chain hydrocarbon and $_x$ represents an arbitrary integer) as additive. As a result, it becomes possible to densely sinter the entirety of the magnet and to prevent the coercive force from degradation. Further, it is preferable to use as organometallic compound to be added an organometallic compound consisting of an alkyl group of which carbon number is any one of integer numbers 2 through 6, which enables the organometallic compound to thermally decompose at a low temperature when calcining the magnet powder in hydrogen atmosphere. Thereby, thermal decomposition of the organometallic compound can be more easily performed over the entirety of the magnet particles.

As described in the above, with respect to the permanent magnet 1 and the manufacturing method of the permanent magnet 1 directed to the above embodiments, an organometallic compound solution is added to fine powder of milled neodymium magnet material so as to uniformly adhere the organometallic compound to particle surfaces of the neodymium magnet powder, the organometallic compound being expressed with a structural formula of M-$(OR)_x$ (M represents Cu or Al, R represents an substituent group consisting of straight-chain or branched-chain hydrocarbon and $_x$ represents an arbitrary integer). Thereafter, a compact body formed through powder compaction of the magnet powder is held for several hours in hydrogen atmosphere at 200 through 900 degrees Celsius for a calcination process in hydrogen. Thereafter, through vacuum sintering or pressure sintering, the permanent magnet 1 is manufactured. Accordingly, Cu or Al contained in the organometallic compound can be concentrated in advance to grain boundaries in a magnet before sintering. Thus, compared with the case where Cu or Al is initially contained in the magnet raw material and then milled and sintered, there can be eliminated the need to set the sintering temperature higher or the sintering period longer in the manufacturing process of the permanent magnet. As a result, the grain growth in the main phase can be inhibited and the rich phase can be dispersed uniformly. Consequently, improvement of coercive force of the permanent magnet 1 can be realized.

Further, the magnet to which organometallic compound has been added is calcined in hydrogen atmosphere so that the organometallic compound is thermally decomposed and carbon contained therein can be burned off previously (i.e., carbon content can be reduced). Therefore, little carbide is formed in a sintering process. Consequently, the entirety of the magnet can be sintered densely without making a gap between a main phase and a grain boundary phase in the sintered magnet and decline of coercive force can be avoided. Further, alpha iron does not separate out in the main phase of the sintered magnet and serious deterioration of magnetic properties can be avoided.

Still further, as typical organometallic compound to be added to magnet powder, it is preferable to use an organometallic compound consisting of an alkyl group, more preferably an alkyl group of which carbon number is any one of integer numbers 2 through 6. By using such configured organometallic compound, the organometallic compound can be thermally decomposed easily at a low temperature when the magnet powder or the compact body is calcined in hydrogen atmosphere. Thereby, the organometallic compound in the entirety of the magnet powder or the compact body can be thermally decomposed more easily.

Still further, in the process of calcining the magnet powder of the compact body, the compact body is held for predetermined length of time within a temperature range between 200 and 900 degrees Celsius, more preferably, between 400 and 900 degrees Celsius. Therefore, carbon contained therein can be burned off more than required.

As a result, carbon content remaining after sintering is 0.2 wt % or less, more preferably, 0.1 wt % or less. Thereby, the entirety of the magnet can be sintered densely without occurrence of a gap between a main phase and a grain boundary phase and decline in residual magnetic flux density can be avoided. Further, this configuration prevents alpha iron from separating out in the main phase of the sintered magnet so that serious deterioration of magnetic characters can be avoided.

In the second manufacturing method, calcination process is performed to the powdery magnet particles, therefore the thermal decomposition of the organometallic compound can be more easily performed to the whole magnet particles in comparison with a case of calcining compacted magnet particles. That is, it becomes possible to reliably decrease the carbon content of the calcined body. By performing dehydrogenation process after calcination process, activity level is decreased with respect to the calcined body activated by the calcination process. Thereby, the resultant magnet particles are prevented from combining with oxygen and the decrease in the residual magnetic flux density and coercive force can also be prevented.

Still further, the dehydrogenation process is performed in such manner that the magnet powder is held for predetermined length of time within a range between 200 and 600 degrees Celsius. Therefore, even if $NdH_3$ having high activity level is produced in a Nd-based magnet that has undergone calcination process in hydrogen, all the produced $NdH_3$ can be changed to $NdH_2$ having low activity level.

Not to mention, the present invention is not limited to the above-described embodiment but may be variously improved and modified without departing from the scope of the present invention.

Further, of magnet powder, milling condition, mixing condition, calcination condition, dehydrogenation condition, sintering condition, etc. are not restricted to conditions described in the embodiment.

Further, the calcination process in hydrogen or the dehydrogenation process may be omitted.

Further, in the embodiment, aluminum ethoxide is used as organometallic compound to be added to magnet powder. Other organometallic compounds may be used as long as being an organometallic compound that satisfies a formula of $M\text{-}(OR)_x$ (in the formula, M represents Cu or Al, R represents a substituent group consisting of a straight-chain or branched-chain hydrocarbon, and $_x$ represents an arbitrary integer). For instance, there may be used an organometallic compound of which carbon number is 7 or larger and an organometallic compound including a substituent group consisting of carbon hydride other than an alkyl group.

EXPLANATION OF REFERENCES

1 permanent magnet
11 main phase
12 R-rich phase

The invention claimed is:

1. A manufacturing method of a Nd—Fe—B based permanent magnet comprising steps of milling magnet material into magnet powder;

adding an organometallic compound expressed with a structural formula of $$M\text{-}(OR)_x$$

M representing Cu or Al, R representing a substituent group consisting of a straight-chain or branched-chain hydrocarbon, and $_x$ representing an arbitrary integer, to the magnet powder obtained at the step of milling magnet material and getting the organometallic compound adhered to particle surfaces of the magnet powder;

compacting the magnet powder of which particle surfaces have got adhesion of the organometallic compound so as to obtain a compact body; and sintering the compact body, wherein M contained in the organometallic compound is concentrated in grain boundaries of the permanent magnet after sintering, wherein the permanent magnet is Nd—Fe—B based.

2. The manufacturing method of a Nd—Fe—B based permanent magnet according to claim 1, wherein R in the structural formula is an alkyl group.

3. The manufacturing method of a Nd—Fe—B based permanent magnet according to claim 2, wherein R in the structural formula is an alkyl group of which carbon number is any one of integer numbers 2 through 6.

* * * * *